US010960994B2

(12) United States Patent
Bierschenk

(10) Patent No.: US 10,960,994 B2
(45) Date of Patent: Mar. 30, 2021

(54) APPARATUS AND METHODS OF PACKAGING PARTICULATES FOR SETTLING

(71) Applicant: Frito-Lay North America, Inc., Plano, TX (US)

(72) Inventor: Patrick Joseph Bierschenk, Dallas, TX (US)

(73) Assignee: Frito-Lay North America, Inc., Plano, TX (US)

( * ) Notice: Subject to any disclaimer, the term of this patent is extended or adjusted under 35 U.S.C. 154(b) by 300 days.

(21) Appl. No.: 15/436,345

(22) Filed: Feb. 17, 2017

(65) Prior Publication Data

US 2018/0237173 A1 Aug. 23, 2018

(51) Int. Cl.

| | |
|---|---|
| ***B65B 1/22*** | (2006.01) |
| ***B65B 9/22*** | (2006.01) |
| ***B65B 9/20*** | (2012.01) |

(52) U.S. Cl.

CPC ..... *B65B 1/22* (2013.01); *B65B 9/2007* (2013.01); *B65B 9/2014* (2013.01); *B65B 9/22* (2013.01)

(58) Field of Classification Search

CPC ..... B65B 9/22; B65B 9/2014; B65B 9/2007; B65B 1/22; B65B 9/20; B65B 9/2028; B65B 37/14; B65B 39/001; B65B 51/30; B65B 57/145; B65B 9/207; B29C 66/4312

USPC ..... 53/437, 551, 552

See application file for complete search history.

(56) References Cited

U.S. PATENT DOCUMENTS

| | | | | |
|---|---|---|---|---|
| 2,600,530 A * | 6/1952 | Griffin | F42B 33/025 | 86/23 |
| 2,757,894 A | 8/1956 | Kindseth | | |
| 3,086,335 A * | 4/1963 | Frank | B65B 9/2014 | 53/551 |
| 3,668,815 A * | 6/1972 | Henry | B65B 1/22 | 53/437 |
| 3,684,254 A * | 8/1972 | Henry | B65B 1/22 | 366/116 |

(Continued)

OTHER PUBLICATIONS

PCT International Search Report and Written Opinion for PCT/US18/15950 dated Apr. 19, 2018 (9 pages).

(Continued)

*Primary Examiner* — Thomas M Wittenschlaeger
*Assistant Examiner* — Scott A Howell
(74) *Attorney, Agent, or Firm* — Barnes & Thornburg LLP; G. Peter Nichols

(57) ABSTRACT

A vertical fill, form and seal (VFFS) apparatus for particulates that facilitates the close-packing ("settling") of the particulates such that a smaller package is needed to contain a mass of particulates in a charge to the VFFS apparatus. The former of the VFFS apparatus, and an associated film driver, move up and down synchronously and in a controlled manner. A partially formed bag, below the former, containing particulates is shaken up and down as the former moves up and down, while the packaging film travels downward continuously in the apparatus. The shaking causes the particulates to settle, and to increase in bulk density. This allows use of less packaging, and lowers use of transportation fuel. In an embodiment, an actuator is in mechanical communication with the former (and its associated film driver) to apply a vertical reciprocating force to the former.

22 Claims, 3 Drawing Sheets

(56) References Cited

U.S. PATENT DOCUMENTS 4,571,926 A * 2/1986 Scully ..... B65B 9/2042 53/170
5,125,213 A * 6/1992 Focke ..... B65B 1/22 53/437
5,473,866 A 12/1995 Maglecic et al.
5,485,712 A * 1/1996 Cherney ..... B65B 9/2028 53/436
5,505,040 A * 4/1996 Janssen ..... B65B 9/2042 53/451
5,540,035 A * 7/1996 Plahm ..... B65B 9/20 53/450
5,682,729 A * 11/1997 Buchko ..... B26D 1/045 53/251
5,724,792 A * 3/1998 Domke ..... B65B 1/22 53/525
5,987,859 A * 11/1999 Dreger ..... B65B 1/22 53/525
6,119,438 A * 9/2000 Bacon ..... B65B 9/20 53/451
6,158,200 A * 12/2000 Taylor ..... B65B 1/22 53/451
6,427,422 B2 * 8/2002 Nakagawa ..... B65B 1/22 53/437
6,463,720 B1 * 10/2002 Cherney ..... B65B 1/22 53/437
7,040,171 B2 * 5/2006 McGee ..... H02K 7/06 438/106
8,371,094 B2 * 2/2013 Bierschenk ..... B65B 37/00 53/525
8,567,165 B2 * 10/2013 Bierschenk ..... B65B 39/001 53/502
8,656,690 B2 * 2/2014 Bierschenk ..... B65B 1/22 53/437
8,776,481 B2 * 7/2014 Miyahara ..... B65B 29/028 53/55
9,221,560 B2 * 12/2015 Dong ..... B65B 1/22
9,227,745 B2 * 1/2016 Miyamoto ..... B65B 1/22
9,250,571 B2 * 2/2016 Acquaviva ..... G03G 15/0894
9,284,075 B2 * 3/2016 Bierschenk ..... B65B 1/00
9,309,013 B2 * 4/2016 Elias ..... B65B 1/22
9,321,547 B2 * 4/2016 Miyamoto ..... B65B 1/22
9,540,123 B2 * 1/2017 Vollenkemper ..... B65B 39/10
9,873,532 B2 * 1/2018 Canestri ..... B65B 43/56
10,144,536 B2 * 12/2018 Katsuyama ..... B65B 1/22
10,279,943 B2 * 5/2019 Uraoka ..... B65B 1/22
2016/0176548 A1 6/2016 Edwards et al.
2016/0176549 A1 * 6/2016 Edwards ..... B65B 31/045 53/437
2016/0236803 A1 * 8/2016 Torii ..... B65B 1/22
2018/0009552 A1 * 1/2018 Wehling ..... B65B 1/22
2018/0215489 A1 * 8/2018 Gallaun ..... B65B 39/007

OTHER PUBLICATIONS

Examination Report dated Dec. 11, 2020 in European Application No. 18754972.0.

* cited by examiner

APPARATUS AND METHODS OF PACKAGING PARTICULATES FOR SETTLING

1. FIELD OF THE INVENTION

The invention relates to the field of high speed particulate product packaging on vertical form fill and seal machines that package a charge of particulates in a package formed on the machine, and more especially to the settling and close-packing of the charge while in a partially-formed bag, during packaging operations.

2. DESCRIPTION OF THE RELATED ART

Vertical fill form and seal machines ("VFFS machines") are commonly used to bag particulate products, including, but not limited to, snack foods that are particulate in nature. Particulate snack foods include, but not limited to, potato chips, corn chips, and extruded snack pieces of various shapes and sizes. These usually enter near the top end of the VFFS machine in measured charges and are each then sealed into a package that is formed on the machine, from packaging film, to contain the snack food charge. The packaging film is most commonly of a heat sealable polymeric composition.

In some VFFS machines the package film advances downward around a forming tube where the free ends of the film are sealed together along the side of the forming tube and sealed transversely by a sealing device as it travels below the forming tube. The partially formed bag, having a sealed side and bottom end, is then filled with the particulate charge and the top of the bag being formed is sealed with another transverse seal.

In some VFFS machines, the motion of the packaging film is halted intermittently as the film is being transversely sealed to form the bag. The step of transverse heat sealing requires a finite amount of time to complete. Consequently, VFFS machines of this type are of intermittent operation. In other VFFS machines, which are of continuous operation, there is a jaw assembly that is adapted for continuous motion of the packaging film.

FIG. 1 depicts schematically a portion of an example of a conventional VFFS apparatus. In sequence, from the top, there is a weigher 101, where particulates, for example particulate snack food to be packaged, are charged and weighed. The weigher 101 accumulates and discharges a specified charge of product corresponding to the amount of product which will occupy a single bag. Downstream from and below the weigher 101 is typically a funnel 102, or a series of funnels, which receives and then directs the charge of product. Downstream from the funnel 102 is a product delivery cylinder 103, which then receives the product charge. As used in a VFFS apparatus, the product delivery cylinder 103 is often referred to as a "former." The packaging film 104, dispensed from a roll 105, is draped around the former 103 and travels downward. A side sealer 106 in slight touching relation to the film, seals the overlapping edges of the packaging film together to form a tube that continues to travel downward under urging from a film driver, such as belt driven rollers (one partially obscured) 107, on opposed sides of the former 103 as the seal is formed. The sealing jaws 108 on either side of the packaging film 104 are each equipped on a leading face of the jaw with a heating element 110 that is moved inward to touch the film, and urge against the film, to form a transverse seal 111, and then retract away from the film 104. Once the transverse seal

111 is formed, the bottom of the tube of packaging film is closed. A charge of product is then delivered through the former 103 and into the sealed partially formed bag, which is in the form of a tube. Thereafter, as the film 104 continues to move downward, the sealing jaws again move so that the heating elements contact and urge against the top region of the partially formed bag to form another transverse seal 112, and then retract away from the seal. Thus, there is formed a bag, sealed at top and bottom, with product therein. A blade may then cut the film above the top seal of the bag (and below the bottom seal of the next bag being formed in the process) to separate the bag from the film. Thus, the VFFS apparatus can fill, and make bags filled with particulates, either continuously without stopping film travel, or with intermittent stops of the film as each a bag is transversely sealed.

During the operations described above, the VFFS apparatus is stationary and does not move either up or down, or laterally. It is generally held in an immobile and fixed position by a support frame (not depicted).

SUMMARY

In an exemplary embodiment of the invention, there is provided a vertical fill, form and seal (VFFS) apparatus for particulates that promotes and facilitates the close-packing ("settling") of the particulates such that a smaller package is needed to contain a mass of particulates in a charge to the VFFS apparatus. The film former and film driver of the VFFS apparatus move up and down in a controlled manner to produce a gentle shaking action of particulates that are in a partially formed bag below the film former and that shake along with the film former, while the packaging film travels smoothly downward around the former. The gentle shaking is such as to minimize breakage in the case of fragile particulates, such as snack foods, and this can be readily ascertained by observation and appropriate adjustment by a person of skill in the art. Nonetheless, the gentle shaking is effective in causing the particulates to settle and to increase the bulk density of the particulates being bagged.

In an exemplary embodiment, a VFFS apparatus for packaging a particulate charge has a film former configured for wrapping a packaging film around an outside surface thereof and for receiving a particulate charge therein. It also has a film driver that urges the film downward in a controlled manner. There is an actuator in mechanical communication with the former and film driver to apply a vertical reciprocating force to the both former as well as film driver to move them up and down in concert. Sealing jaws are located below the former to transversely seal packaging film exiting off the former to form a bag containing the particulate charge, when the apparatus is in use. A controller is in communication with the actuator and is configured to control a frequency and amplitude of the reciprocating force applied by the actuator. Accordingly, when in use, the synchronous reciprocal motion of the former and its associated film driver causes shaking of a partially formed bag of packaging film below the former. This shaking causes settling of particulates in the partially formed bag to thereby increase the bulk density of the particulates. As a consequence, a smaller package (less volume) can be used to contain the charge, as opposed to the package necessary when the same mass of charge was packaged in a VFFS that has a stationary film former and film driver.

As a direct consequence of the enablement of smaller packaging due to close packing of the particulate contents, smaller packages can be made, and packaging waste for disposal after use is reduced, thus minimizing landfill use. Further, the smaller packages enable use of smaller cartons. This translates to a greater number of cartons per truckload, since truck loads are very often limited by volume rather than mass, especially for low bulk density particulates, such as snack foods. Fewer truckloads result in savings in fuel consumption, and in reduction in carbon footprint. Accordingly, the technology provides energy savings as well as facilitating preservation and/or maintaining the environment.

In the exemplary embodiment, a minimum distance between the lower end of the former and the sealing jaws is maintained during the up and down movement of the former and the sealing jaws. This minimum distance permits tuckers to be inserted to shape the packaging film exiting off the base of the former for making a formatted bag, while the packaging film moves continuously through the apparatus without interruption. Of course, in some instances, the packaging film motion may be interrupted, if desirable, for any reason.

Further, in exemplary apparatus, the sealing jaws may also move up and down in concert with the former, if that is useful in a particular application of the VFFS apparatus.

Other features that are included in the exemplary VFFS apparatus include a side seal bar adjacent the former such that side seal bar moves up and down in concert with the former to maintain its vertical displacement relative to the former.

In addition, in the exemplary embodiment, the package film driver, which is under control of the controller, and that moves the packaging film downward around the outside surface of the former, may move up and down in concert with the former. It thereby maintains a constant vertical displacement relative to the former and ensures smooth packaging film travel. The package film driver may operate to smoothly and continuously guide packaging film downward around the former, without interruption. In other embodiments, it may operate intermittently.

Further, in the exemplary embodiment, the controller may be configured to intermittently stop applying reciprocal force and to stop the package film drive roller thereby stopping package film movement. This may take place at any useful point in the packaging cycle, for example, while a bag is being transversely sealed by the sealing jaws.

In the exemplary embodiment, the amplitude of the up and down motion is in the range from 1.5 to 6 mm and the frequency may be in the range 5 to 20 Hz.

There is also provided an exemplary method of reducing an amount of packaging film necessary to package particulates in a vertical fill, form and seal (VFFS) apparatus. The method includes moving a former and film driver of the VFFS apparatus up and down in a controlled synchronous reciprocation, while feeding a packaging film around the former. Further, forming a side seal in the packaging film while the former is in reciprocating up and down motion. And feeding a charge of an amount of a plurality of particulates to the apparatus and into the former to be packaged, while the former and film driver are in reciprocating up and down motion. Allowing the charge to exit from a base end of the former into a partially formed bag of the packaging film. The up and down motion of the former causes shaking of particulates in the partially formed bag such that the bulk density of the charge increases. In the event that the charge is of a fragile nature, the severity of the shaking may be appropriately adjusted by a person of skill in the art taking into account an acceptable level of breakage, depending upon the nature of the particulate product, and its market acceptance. Then, sealing the partially formed bag to form a bag containing the higher bulk density particulates. The reciprocating up and down motion of the former increases the bulk density of the particulates relative to the bulk density without the up and down motion, to permit bagging of the same mass of particulates in a smaller bag.

The exemplary embodiment of the method may further include maintaining a controlled distance between the former and the sealing jaws. And, the exemplary embodiment of the method may further include that the controlled distance allows insertion and removal of tuckers for making formatted bags, without interference with sealing jaw operation.

The exemplary embodiment of the method may further include moving the sealing jaws up and down in concert with the former.

The exemplary embodiment of the method may further include feeding the packaging film continuously, without intermittent stopping during packaging operations. Or, it may include feeding the packaging film intermittently, with controlled stopping at intervals during packaging operations.

In the exemplary embodiment of the method, the amplitude of the up and down motion is in the range from 1.5 to 6 mm. And, the frequency of the up and down motion is in the range 5 to 20 Hz.

In the exemplary embodiment of the method, the particulate charge may be snack food particulates. The snack food particulates may include, but is not limited to, potato chips, potato-based particulates, wheat based particulates, and corn-based particulate snack foods.

BRIEF DESCRIPTION OF THE DRAWINGS

The foregoing aspects and many of the attendant advantages of the present technology will become more readily appreciated by reference to the following Detailed Description, when taken in conjunction with the accompanying simplified drawings of exemplary embodiments. The illustrative, schematic drawings, briefly described here below, are not to scale, are presented for ease of explanation and do not limit the scope of the inventions recited in the accompanying patent claims.

DETAILED DESCRIPTION

Figure 1:
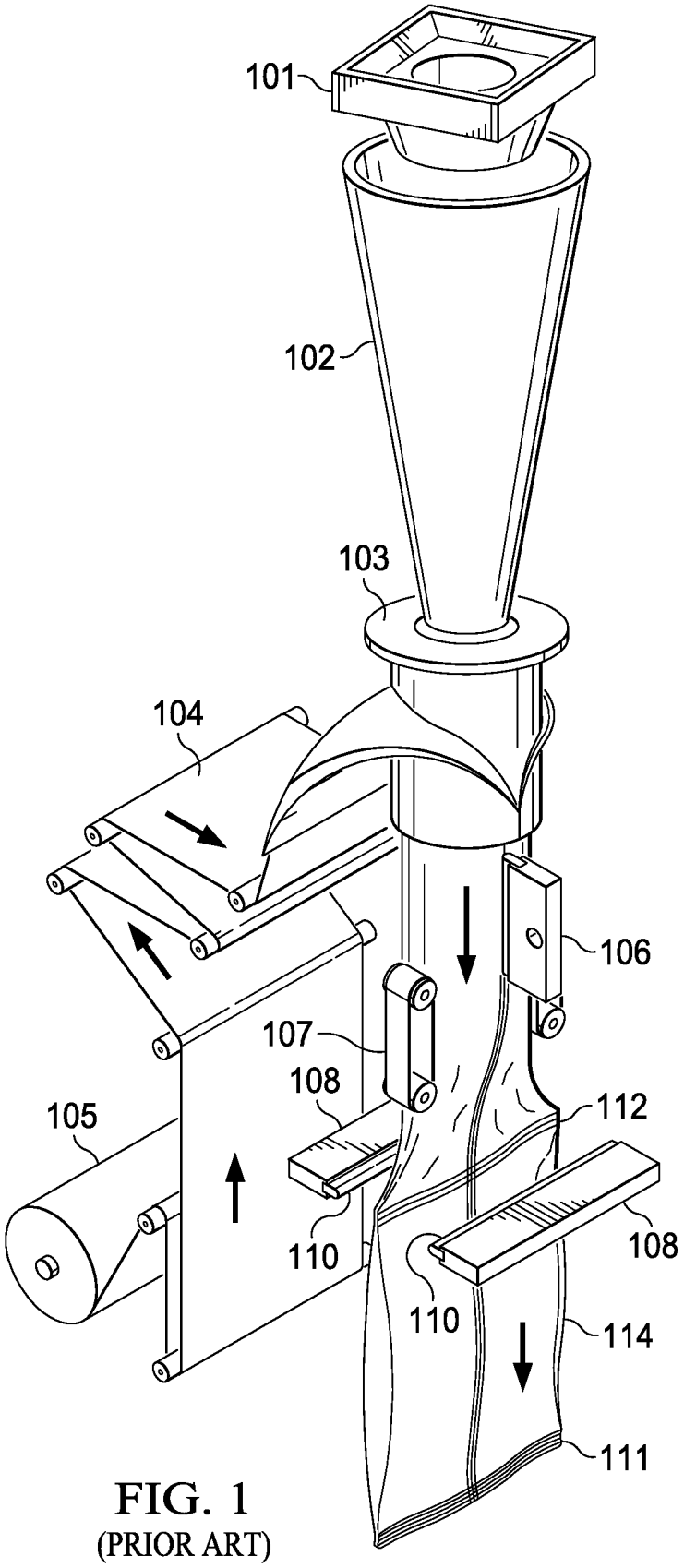
FIG. 1 (PRIOR ART)
FIG. 1 is a schematic depiction of a prior art vertical form, fill and seal apparatus.

The following non-limiting detailed descriptions of examples of embodiments of the technology may refer to appended drawing Figures and are not limited to the drawings, which are merely presented for enhancing explanations of features of the technology. In addition, the detailed descriptions may refer to particular terms of art, some of which are defined herein, as appropriate and necessary for clarity.

In the specification and claims, the terms "compacted," "close packed" and "settled" in reference to a charge of particulates means that the charge of particulates has been treated by shaking up and down, such that the particulates are oriented relative to each other in a closer packed relation than prior to compaction treatment. In the event of fragile or brittle charges, such as some particulate snack foods, the vigor of the compaction treatment should be such as to reduce any breakage to consumer acceptable levels. The shaking that minimizes breakage of fragile particulates, such as some snack foods is referred to herein as "gentle" shaking. This is readily determined by observation and cured by adjustment of frequency and/or amplitude of shaking. By treatment to compact the charge, the volume that the charge occupies is reduced; i.e. the bulk density increases. As a result, a smaller package or bag can be used to contain the charge, than could be used with a non-compacted charge. This results in savings in packaging material, reduced carton sizes for containing the packages, fewer transportation trips to distribute the cartons (saving fuel, and reducing carbon footprint), and reducing landfill needs for waste disposal of used packages. Accordingly, applying a treatment that close packs the particulate charges to the VFFS for packaging presents several advantages.

An issue that arises once a charge enters the top of the film former tube, is that as the charge falls under gravity within the former, the charge becomes more dispersed, and less close packed. Accordingly, for a given mass of the charge, its volume increases (and its bulk density decreases). Improving compaction in the packaging apparatus is a significant goal in order to meet at least some of the advantages detailed here above.

On the other hand, when an already compacted charge enters the top of the film former tube, as the charge falls under gravity within the former, the charge loses at least some of its degree of compaction, so that its volume increases (and its bulk density decreases). Maintaining compaction, or at least minimizing the loss of compaction of the charge is a significant goal in to meet at least some of the advantages detailed here above.

The invention provides a VFFS apparatus and method of using the apparatus that includes a former and associated film driver that reciprocates up and down in a controlled manner such that a charge of particulates in a partially formed bag (i.e. one not yet sealed at the top) below the former undergoes shaking that induces settling (close packing), while the packaging film travels downward continuously. The particulates are more compact (higher bulk density) than it would have been but for the former reciprocation. In accordance with the invention, this allows the use of smaller packages ("bags") thereby using less packaging material, and the resultant savings in waste disposal, fuel, and reduction in carbon footprint, set forth above.

Figure 2:
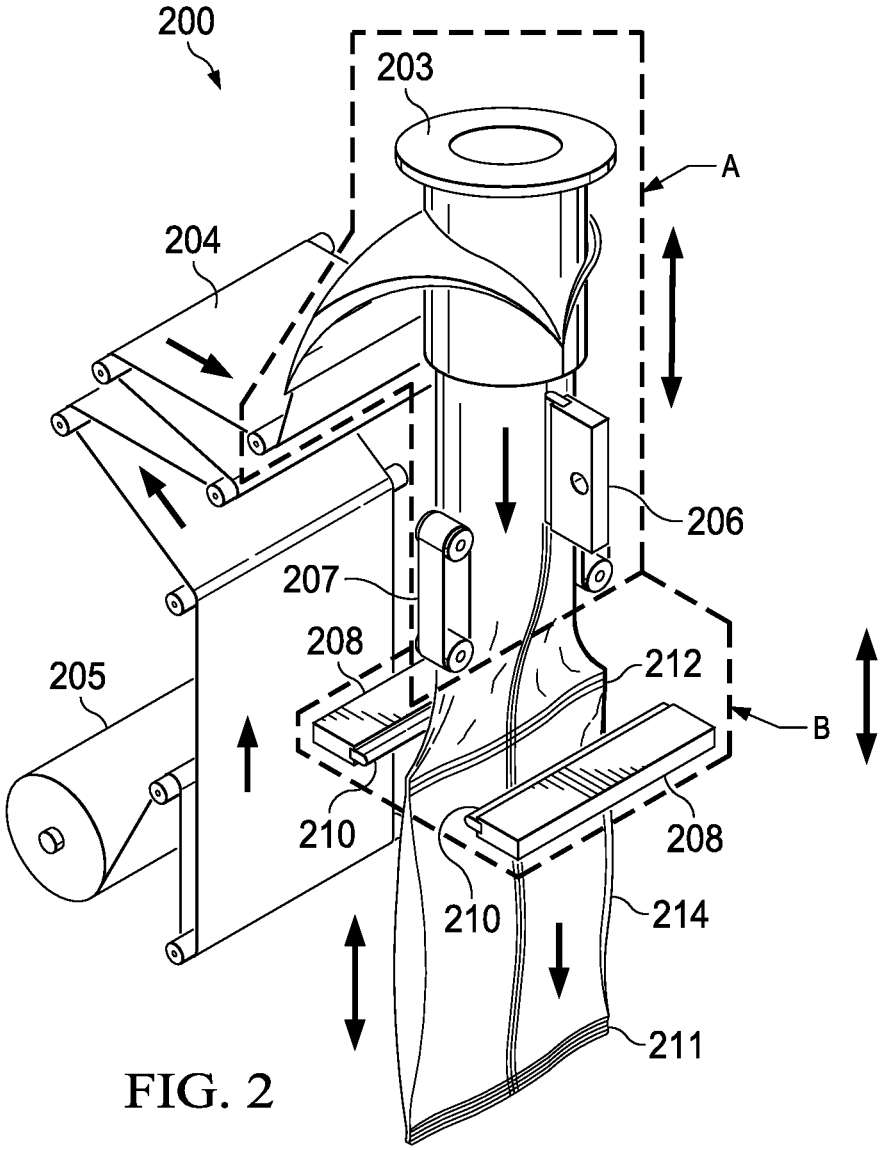
FIG. 2 is a schematic showing the sections A, B and other components of an exemplary embodiment of the inventive vertical fill form and seal apparatus that may reciprocate up and down.

FIG. 1 depicts schematically a prior art VFFS, which is described here above. FIG. 2 depicts schematically the components of the VFFS 200 that is being used to make a bag 214, that has a bottom seal 211 in place and an upper seal 212, formed by the heat bars 210 of seal jaws 208. Referring to FIG. 2, the outlined sections A, and (optionally) B, are in reciprocal motion, according to exemplary embodiments of invention. As indicated at A, the former 203, its associated side seal apparatus 206, and the packaging film drivers 207 all reciprocate in concert. Thus, they are invariant in their displacement relative to each other.

In some embodiments, as indicated at B, the sealing jaws 208 also reciprocate in concert with the former 203 and the packaging film drivers 207, if necessary and/or desirable.

Further, if necessary and/or desirable the packaging film supply including the drive roller 205 may also reciprocate synchronously with the former 203 and the film drivers 207.

Figure 3:
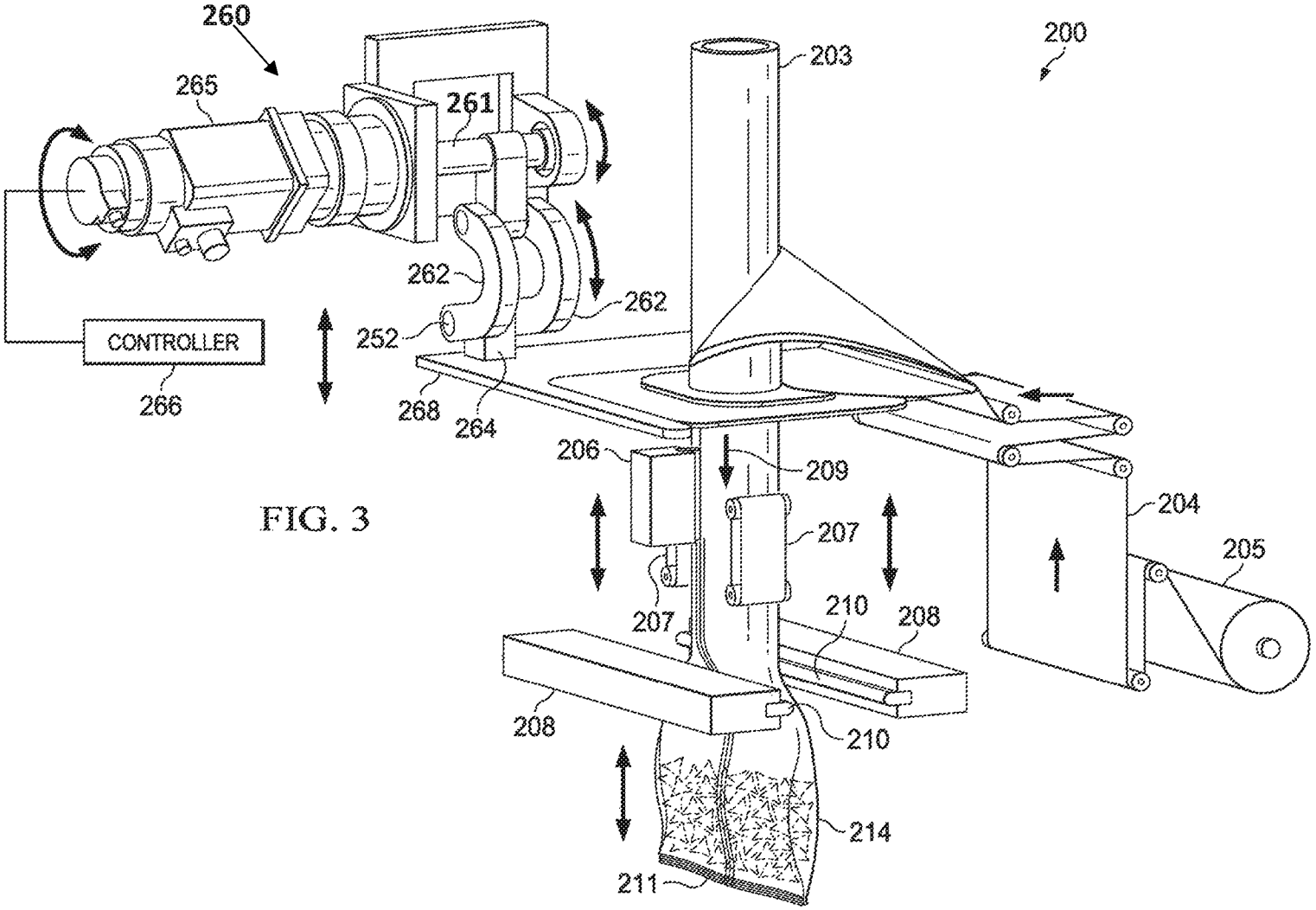
FIG. 3 is a schematic illustration of mechanical components of an exemplary embodiment of a vertical fill form and seal apparatus according to the invention, where the former (and other associated components) reciprocates up and down.

In the exemplary embodiment of FIG. 3, there is schematically presented a mechanical detail of an example in accordance with the invention. Other mechanical means can, of course, also be used to cause the desired reciprocation discussed herein. FIG. 3 shows a motor-driven actuator 260 having a shaft 261 rotating alternately in clockwise and counter-clockwise motion which moves a plate 268 that is mechanically attached to the former 203, up and down, in a controlled manner. Controller 266 controls the direction, speed and frequency of reversal of direction of motor 265. The motor 265 is operatively coupled to drive the actuator 260, which includes a shaft 261 connected to a pair of grasping hooks 262 that lift or descend, depending upon the direction of turning of motor 265 and shaft 261. The grasping hooks 262 are mechanically coupled to an attachment 264, by one hook facing each outboard side of the attachment. A pin 252 passes through the attachment 264 of plate 268. Each of the grasping hooks 262 is able to rotate about the pin 252 as the grasping hooks move up and down, and as a result moves the plate 268 up and down. Since plate 268 is fixedly coupled to former 203, the former 203 moves up and down along with the plate 268. In addition, as indicated with reference to A at FIG. 2, the film drivers 207, which are associated with the former 203, move in concert with the former 203. To facilitate this, the film drivers 207 may also be mechanically coupled to the support structure that moves in concert with the former 203. So, in operation, the film 204 moves continuously around the former 203 and downward, as indicated by arrow 209, uninterrupted by the reciprocating motion. Thus, the packaging film does not "pulse" in its smooth, continuous downward travel, relative to the former 203. As indicated above, in reference to FIG. 2, the portion A of the apparatus includes the side seal 206, which also moves in concert with the former 203. The side seal 206 may be mechanically coupled to the plate 268, or to other support structure that moves with the former 203.

Moreover, as previously indicated at B of FIG. 2, the jaws 208 may also move up and down in concert with the former 203, if necessary and desirable.

In some embodiments, a minimum distance between the lower end of the former 203 and the sealing jaws 208 is maintained during the up and down movement of the former and the sealing jaws. This minimum distance permits tuckers to be inserted to shape the packaging film exiting off the base of the former for making a formatted bag, while the packaging film moves continuously and smoothly downward through the apparatus without interruption. Of course, in some instances, the packaging film motion may be interrupted, if desirable, for any reason.

The variants of the embodiment, having more or less mechanical components of the VFFS apparatus that move in concert with reciprocation of the former 203, are all within the scope of the invention, and each may have a particular usefulness in a particular application. They each embody the transmitting of an up and down reciprocating motion from the former to the partially formed bag such that the charge in this partially formed bag is shaken to allow settling and increase in bulk density. This increase in bulk density allows a smaller bag for packaging the same mass of particulates.

The foregoing exemplary apparatus is not limiting of the invention, and the examples may be modified in a variety of ways to achieve the controlled up and down reciprocation. Conventional VFFS apparatus may readily be retrofitted to practice the technology herein described to obtain (at least) the benefits set forth here. All modifications are within the scope of the invention, as claimed here below. The VFFS apparatus of the invention is flexible, and can be used with a variety of packaging operations and types of bags. For example, it can be used with the typical pillow bag, as well as with large pillow bags. And, it can be used in making formatted bags, including but not limited to, single sided gusseted bags, or double sided gusseted bags, or bags with a flat base shaped for standing upright for display. In some cases, it may be advantageous to maintain a controlled distance between the former and the sealing jaws, for example to allow insertion and removal of tuckers for making formatted bags without interference with sealing jaw operation.

While examples of embodiments of the technology have been presented and described in text and some examples also by way of illustration, it will be appreciated that various changes and modifications may be made in the described technology without departing from the scope of the inventions, which are set forth in, and only limited by, the scope of the appended patent claims, as properly interpreted and construed.

Additional Disclosures

The clauses presented here are not patent claims, and are further disclosures of inventive embodiments, Clause 1. A vertical form fill and seal apparatus for packaging a particulate charge, the vertical form fill and seal apparatus comprising:

a former configured for wrapping a packaging film around an outside surface thereof and for receiving a particulate charge therein;

a film driver associated with the former and controlledly moving packaging film down around the former;

an actuator in mechanical communication with the former and the film driver, the actuator applying a vertical reciprocating force to the former and the film driver to move both former and film driver up and down synchronously;

sealing jaws located below the former to transversely seal packaging film exiting off the former to form a bag containing the particulate charge, when the apparatus is in use; and a controller in communication with the actuator and configured to control a frequency and amplitude of the reciprocating force applied by the actuator;

whereby when in use, the synchronous reciprocal motion of the former and the film driver causes shaking of particulate contents a partially formed bag below the former, the shaking causing settling of the particulate contents in the partially formed bag to increase a bulk density of the particulates.

Clause 2. The vertical form fill and seal apparatus of clause 1, further comprising a side seal bar adjacent the former, the side seal bar moving up and down in concert with the former to maintain a vertical displacement relative to the former.

Clause 3. The vertical form fill and seal apparatus of any preceding clause, wherein a particulate charge to the apparatus is a snack food charge and the synchronous reciprocal motion of the former and the film driver causes gentle shaking of particulates when these are in a partially formed bag, to increase a bulk density thereof.

Clause 4. The vertical form fill and seal apparatus of any preceding clause, wherein the package film drive roller operates to continuously guide packaging film downward around the former, without interruption.

Clause 5. The vertical form fill and seal apparatus of clause 4, wherein the controller is configured to intermittently stop applying reciprocal force and to stop the package film driver thereby stopping package film movement while a bag is being transversely sealed by the sealing jaws.

Clause 6. The vertical form fill and seal apparatus of any preceding clause, wherein the sealing jaws move up and down in concert with the former.

Clause 7. The vertical form fill and seal apparatus of any preceding clause, wherein a minimum distance between a lower end of the former and the sealing jaws is maintained during the up and down movement of the former and the sealing jaws, the minimum distance permitting tuckers to be inserted to shape the packaging film exiting off the former for making a formatted bag, while packaging film moves continuously through the apparatus without interruption.

Clause 8. The vertical form fill and seal apparatus of any preceding clause, wherein, when a compacted charge of particulates having a bulk density is charged to the apparatus, the reciprocal motion of the former increases a packaged bulk density of the particulates relative to an apparatus lacking shaking of the partially formed bag caused by reciprocating motion of the former and film driver.

Clause 9. The vertical form fill and seal apparatus of any preceding clause, wherein the amplitude of the up and down motion is in the range from 1.5 to 6 mm.

Clause 10. The vertical form fill and seal apparatus of any preceding clause, wherein the frequency of the up and down motion is in the range 5 to 20 Hz.

Clause 11. A vertical form fill and seal apparatus for packaging a particulate charge, the vertical form fill and seal apparatus comprising:

a former configured for wrapping a packaging film around an outside surface thereof and for receiving a particulate charge therein;

a film driver associated with the former for continuously guiding a packaging film downward around the former;

sealing jaws located below the former to transversely seal packaging film exiting off a bottom of the former to form a bag containing the particulate charge, when the apparatus is in use;

an actuator in mechanical communication with the former, and the film driver, the actuator applying a vertical reciprocating force to the former and film driver; and a controller in communication with the actuator and configured to control a frequency of the reciprocating force in the range 5 to 20 Hz and an amplitude in the range 1.5 to 6 mm;

whereby when in use, the reciprocal motion of the former increases bulk density of a particulate charge being packaged in the vertical form fill and seal apparatus, relative to an apparatus lacking reciprocating motion.

Clause 12. A method of reducing an amount of packaging film necessary to package particulates in a vertical fill, form and seal apparatus, the method including:

moving a former of the vertical fill, form and seal apparatus up and down in a controlled reciprocation;

feeding a packaging film continuously around the former while the former is in reciprocating up and down motion;

forming a side seal in the packaging film while the former is in reciprocating up and down motion, and while the packaging film travels downward continuously;

feeding a charge of an amount of a plurality of particulates to the vertical fill, form and seal apparatus and into the former to be packaged, while the former is in reciprocating up and down motion, and while the packaging film travels downward continuously;

exiting the charge from a base end of the former into a partially formed bag of the packaging film;

shaking a the particulate charge in the partially formed bag to increase a bulk density of the particulates, while the packaging film travels downward continuously; and sealing the partially formed bag to form a bag containing the charge;

whereby the particulate charge is contained in a smaller bag as a result of the increased bulk density, as compared to a bag produced on an apparatus lacking up and down motion of the former that causes shaking of the partially formed bag contents.

Clause 13. The method of clause 12, further including maintaining a controlled distance between the former and the sealing jaws.

Clause 14. The method of any preceding clause, wherein the controlled distance allows insertion and removal of tuckers for making formatted bags without interference with sealing jaw operation.

Clause 15. The method of any preceding clause, further comprising moving the sealing jaws up and down in concert with the former.

Clause 16. The method of any preceding clause, wherein the step of feeding the packaging film is continuous without intermittent stopping during packaging operations.

Clause 17. The method of any of preceding clauses 12-15, wherein the step of feeding the packaging film is intermittent with controlled stopping during packaging operations.

Clause 18. The method of any preceding clause, wherein an amplitude of the up and down motion is in the range from 1.5 to 6 mm.

Clause 19 The method of any preceding clause, wherein a frequency of the up and down motion is in the range 5 to 20 Hz.

Clause 20. The method of any preceding clause, wherein the particulate charge comprises snack food particulates.

Clause 21. The method of any preceding clause, wherein the snack food particulates are selected from potato chips and corn-based particulate snack foods.

The invention claimed is:

1. A vertical form fill and seal apparatus for packaging a particulate charge, the vertical form fill and seal apparatus comprising:

a former configured for wrapping a packaging film around an outside surface thereof and for receiving a particulate charge therein;

a film driver associated with the former to continuously move the packaging film down around the former without interruption;

a motor-driven actuator comprising a shaft rotating alternately in clockwise and counter-clockwise motion and a hook arrangement moving up or down depending upon direction of shaft rotation, the actuator in rotatable mechanical communication with the former and the film driver, wherein the actuator applies a vertical reciprocating force to the former and the film driver to move both the former and the film driver up and down synchronously while the film driver continuously and without interruption moves the packaging film down around the former;

sealing jaws located below the former to transversely seal packaging film exiting off the former to form a bag containing the particulate charge, when the apparatus is in use; and a controller in communication with the actuator and configured to control a frequency of the reciprocating force applied by the actuator.

2. The vertical form fill and seal apparatus of claim 1, further comprising a side seal bar adjacent the former, the side seal bar moving up and down in concert with the film former to maintain a vertical displacement relative to the former.

3. The vertical form fill and seal apparatus of claim 1, wherein a particulate charge to the apparatus is a snack food charge and the synchronous reciprocal motion of the former and the film driver causes gentle shaking of particulates when these are in a partially formed bag, to increase a bulk density thereof.

4. The vertical form fill and seal apparatus of claim 1, wherein the sealing jaws move up and down in concert with the former.

5. The vertical form fill and seal apparatus of claim 4, wherein a distance between a lower end of the former and the sealing jaws is maintained during the up and down movement of the former and the sealing jaws, the distance facilitating making a formatted bag, while packaging film moves continuously through the apparatus without interruption.

6. The vertical form fill and seal apparatus of claim 1, wherein, when a compacted charge of particulates having a bulk density is charged to the apparatus, the reciprocal motion of the former increases a packaged bulk density of the particulates relative to an apparatus lacking shaking of the partially formed bag caused by reciprocating motion of the former and film driver.

7. The vertical form fill and seal apparatus of claim 1, wherein the amplitude of the up and down motion is in the range from 1.5 to 6 mm.

8. The vertical form fill and seal apparatus of claim 1, wherein the frequency of the up and down motion is in the range 5 to 20 Hz.

9. The vertical form fill and seal apparatus of claim 1, wherein the actuator moves a plate up and down as the actuator rotates, the plate mechanically affixed to the former such that the former moves up and down with the plate.

10. The vertical form fill and seal apparatus of claim 1, wherein the hook arrangement has a first end rotatably fixed to the shaft and a second end such that the hook arrangement moves up or down depending upon direction of shaft rotation, the actuator in rotatable mechanical communication with the former and the film driver, the actuator applying a vertical reciprocating force to the former and the film driver to move both the former and the film driver up and down synchronously through rotation at the first and second end.

11. A vertical form fill and seal apparatus for packaging a particulate charge, the vertical form fill and seal apparatus comprising:

a former configured for wrapping a packaging film around an outside surface thereof and for receiving a particulate charge therein;

a film driver associated with the former for continuously guiding the packaging film downward around the former without interruption;

sealing jaws located below the former to transversely seal the packaging film exiting off a bottom of the former to form a bag containing the particulate charge, when the apparatus is in use;

a motor-driven actuator in mechanical communication with the former and the film driver, the actuator comprising a shaft generating rotational forces, wherein the actuator applies vertical reciprocating forces to the former and film driver through a hook arrangement moving up or down depending upon shaft rotation while the film driver continuously and without interruption moves the packaging film down around the former; and a controller in communication with the actuator and configured to control a frequency of the reciprocating forces in the range 5 to 20 Hz and an amplitude in the range 1.5 to 6 mm.

12. The vertical form fill and seal apparatus of claim 11, wherein the actuator moves a plate up and down as the actuator rotates, the plate mechanically affixed to the former such that the former moves up and down with the plate.

13. The vertical form fill and seal apparatus of claim 11 wherein the hook arrangement has a first end rotatably fixed to the shaft and a second end rotatably connected to the former and the film driver, such that the former and film driver moves up or down depending upon shaft rotation.

14. A method of reducing an amount of packaging film necessary to package particulates in a vertical fill, form and seal apparatus, the method including:

moving a former of the vertical fill, form and seal apparatus up and down in a controlled reciprocation under mechanical urging from a motor-driven actuator, the actuator having a shaft generating rotational forces, the rotational forces translated to the controlled reciprocation by mechanical components comprising a hook and a pin;

feeding a packaging film continuously around the former while the former is in reciprocating up and down motion;

forming a side seal in the packaging film while the former is in reciprocating up and down motion, and while the packaging film travels downward continuously and without interruption;

feeding a charge of a plurality of particulates to the vertical fill, form and seal apparatus and into the former to be packaged, while the former is in reciprocating up and down motion, and while the packaging film travels downward continuously;

exiting the charge from a base end of the former into a partially formed bag of the packaging film;

shaking a the particulate charge in the partially formed bag to increase a bulk density of the charge in the bag, while the packaging film travels downward continuously and without interruption; and sealing the partially formed bag to form a bag containing the charge.

15. The method of claim 14, further including maintaining a distance between the former and the sealing jaws.

16. The method of claim 15, wherein the maintained distance facilitates making formatted bags without interference with sealing jaw operation.

17. The method of claim 14, further comprising moving the sealing jaws up and down in concert with the former.

18. The method of claim 14, wherein an amplitude of the up and down motion is in the range from 1.5 to 6 mm.

19. The method of claim 14, wherein a frequency of the up and down motion is in the range 5 to 20 Hz.

20. The method of claim 14, wherein the particulate charge comprises snack food particulates.

21. The method of claim 20, wherein the snack food particulates are selected from potato chips and corn-based particulate snack foods.

22. The method of claim 14 wherein the hook has a first end rotatably fixed to the shaft and has a second end that receives the pin for rotatable connection to the former.

* * * * *